US007914069B2

(12) United States Patent
Barbe et al.

(10) Patent No.: US 7,914,069 B2
(45) Date of Patent: Mar. 29, 2011

(54) PROTECTION DEVICE FOR VEHICLE FLOOR PAN

(75) Inventors: Yves Barbe, Bois d'Arcy (FR); Sebastien Carrie, Sucy en Brie (FR); Laurent Wagnez, Bourges (FR)

(73) Assignee: Nexter Systems, Roanne (FR)

( * ) Notice: Subject to any disclaimer, the term of this patent is extended or adjusted under 35 U.S.C. 154(b) by 0 days.

(21) Appl. No.: 11/793,783

(22) PCT Filed: Dec. 5, 2005

(86) PCT No.: PCT/FR2005/003025

§ 371 (c)(1),
(2), (4) Date: Jun. 21, 2007

(87) PCT Pub. No.: WO2006/067291

PCT Pub. Date: Jun. 29, 2006

(65) Prior Publication Data

US 2008/0111396 A1 May 15, 2008

(30) Foreign Application Priority Data

Dec. 21, 2004 (FR) ..... 04 13619

(51) Int. Cl.
*F41H 7/04* (2006.01)

(52) U.S. Cl. ..... 296/193.07; 89/36.08

(58) Field of Classification Search ..... 296/193.07, 296/187.08, 190.03, 35.2; 89/36.08, 36.09, 89/36.17

See application file for complete search history.

(56) References Cited

U.S. PATENT DOCUMENTS

| | | | | |
|---|---|---|---|---|
| 3,604,374 | A | 9/1971 | Matson et al. | 109/81 |
| 4,404,889 | A * | 9/1983 | Miguel | 89/36.02 |
| 5,517,894 | A * | 5/1996 | Bohne et al. | 89/36.02 |
| 5,654,518 | A * | 8/1997 | Dobbs | 89/36.02 |
| 5,866,839 | A * | 2/1999 | Ohayon | 89/36.08 |
| 6,477,934 | B1 * | 11/2002 | Bruhn et al. | 89/36.08 |
| 6,544,624 | B1 * | 4/2003 | Lopez-Anido et al. | 428/118 |
| 6,779,431 | B2 | 8/2004 | Hönlinger | 89/36.08 |

FOREIGN PATENT DOCUMENTS

| | | | |
|---|---|---|---|
| DE | 3106694 | A1 * | 9/1982 |
| DE | 197 35 594 | A1 | 2/1999 |
| EP | 0 897 097 | A2 | 2/1999 |
| EP | 1 045 220 | A2 | 10/2000 |
| WO | WO 2004/038320 | | 5/2004 |
| WO | WO 2004/104511 | | 12/2004 |
| WO | WO 2004104511 | A1 * | 12/2004 |

* cited by examiner

*Primary Examiner* — Glenn Dayoan
*Assistant Examiner* — Melissa A Black
(74) *Attorney, Agent, or Firm* — Steptoe & Johnson LLP

(57) ABSTRACT

A device to protect the floor pan of a land vehicle against mines, which device incorporates at least one layer of deformable reinforcements positioned between a plane front plate and a plane rear plate, the surface density of the front plate being greater than that of the reinforcements.

17 Claims, 3 Drawing Sheets

PROTECTION DEVICE FOR VEHICLE FLOOR PAN

The present application is based on International Application PCT/JP2005/003025, filed Dec. 5, 2005, which claims priority to French Application No. 0413619, Filed Dec. 21, 2004, the entire contents of which are hereby incorporated by reference.

BACKGROUND

The technical scope of the invention is that of devices to ensure the protection against mines of the floor pan of a land vehicle.

To protect the floor pan of a land vehicle it is known to affix armour under it that enables the energy produced by the mine blast to be absorbed. Known armour comprises one or several metallic or composite layers and possibly deflection means. Patent WO03/102489 thus describes convex add-on armour ensuring the protection of the mechanical transmission means of the vehicle.

Known armours are not adapted for the protection of vehicles having low ground clearance, typically about 400 to 500 mm. These vehicles are particularly vulnerable to mines and namely to blast-effect antitank and antipersonnel mines.

BRIEF SUMMARY OF THE INVENTION

The aim of the invention is to propose a protection device able to ensure, with a relatively reduced total thickness, effective protection for the floor pans of vehicles against the effects of mines, and namely blast-effect mines.

Thus, the invention relates to a device to protect the floor pan of a land vehicle against mines, a device which incorporates at least one layer of deformable reinforcement parts positioned between a plane front plate and a plane rear plate, the surface density of the front plate being greater than that of the reinforcement.

The ratio of the reinforcement surface density to the surface density of the front plate will advantageously be less than 0.7.

The reinforcements may be constituted by at least one row of at least two tubes.

According to one embodiment, the device incorporates at least two reinforcement parts in contact with one another and arranged at a substantially median part of the front plate.

The device may incorporate at least one row of reinforcement parts in side-by-side contact with one another and spaced over substantially the entire area of the floor pan.

The front plate may be rectangular and the reinforcements may have their axes parallel with one length of the front plate.

Or, the front plate may be rectangular and the reinforcements may have axes parallel with one width of the front plate.

The rear plate may be constituted by the floor pan of the vehicle itself.

The rear plate may advantageously be integral with the front plate and the reinforcements thus forming a protective casing adaptable to the floor pan of a vehicle.

BRIEF DESCRIPTION OF THE DRAWINGS

The invention will become more apparent from the following description of different embodiments, such description being made with reference to the appended drawings, in which.

DETAILED DESCRIPTION OF THE INVENTION

Figure 1:
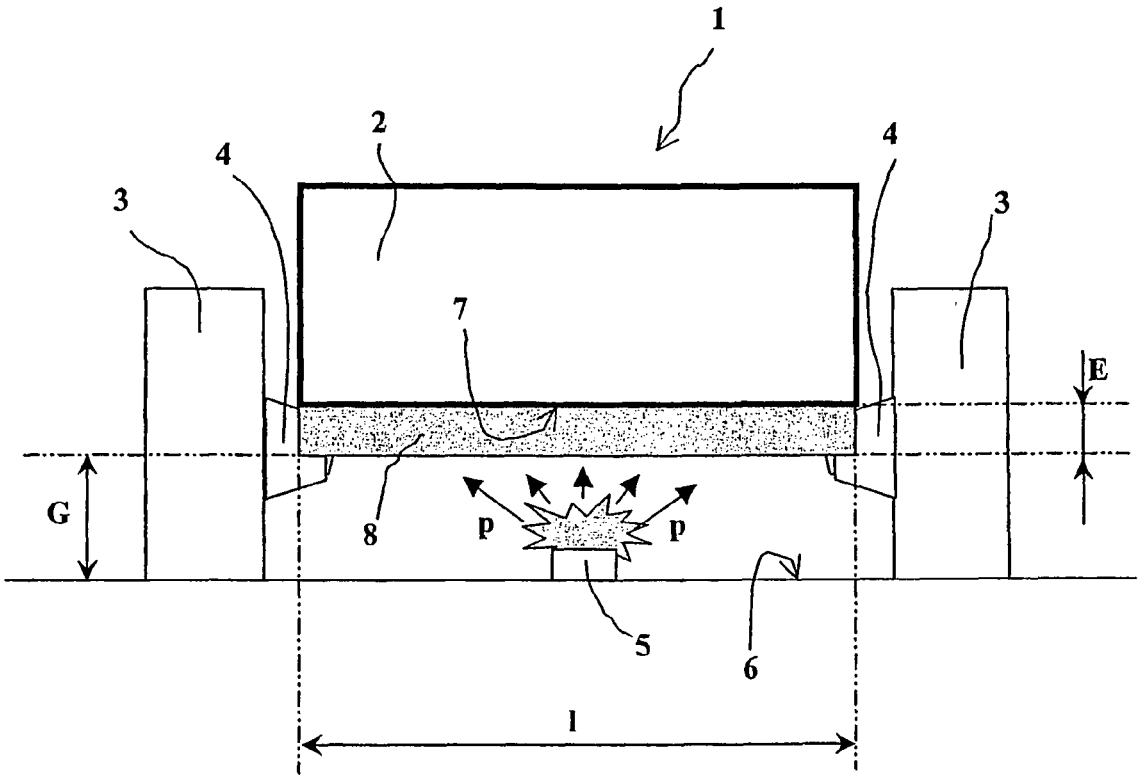
FIG. 1 schematically shows a vehicle passing over a mine, such vehicle equipped with a floor pan protection device according to the invention.

With reference to FIG. 1, a vehicle 1 incorporates a cab 2 carried by wheels 3 connected to the cab by an axle 4. FIG. 1 shows a blast-effect mine 5 positioned on the ground 6. During its ignition, this mine generates high pressure (represented by arrows p) on the floor pan 7 of the vehicle 1.

In accordance with the invention, to enable the floor pan 7 to withstand the blast effects, a protection device 8 is affixed to it.

Even though the vehicle has low ground clearance, the vehicle equipped with the device 8 has residual ground clearance G greater than 300 mm.

Figure 2:
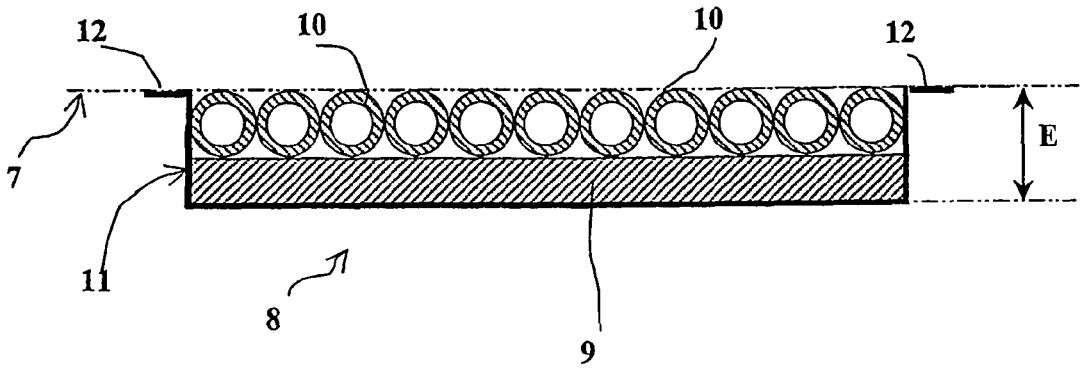
FIG. 2 shows a first embodiment of a protection device according to the invention.

FIG. 2 shows a first embodiment of such a device 8. This protection device 8 incorporates a plane front plate 9 made of a material having high mechanical strength, as well as a layer of deformable reinforcement parts 10.

Here, the deformable reinforcement parts are tubes made of a material having high mechanical properties.

The tubes 10 are thus placed between the front plate 9 and a rear plate which here is the floor pan 7 of the vehicle.

To facilitate assembly of the device, a case 11, for example, of bent sheet metal, receives the front plate 9 and the reinforcement parts 10 and incorporates lugs 12 enabling it to be fastened to the floor pan 7 of the vehicle 1.

According to another characteristic of the invention, the surface density of the front plate 9 is greater than that of the reinforcements 10. Thus, a ratio of surface density of the reinforcements to the surface density of the plate will advantageously be chosen to be less than or equal to 0.7.

By surface density we mean the ratio of the mass of the element in question to the surface of the floor pan 7 covered by said element.

The rectangular floor pan of width 1 and length L is covered. For the embodiment in FIG. 2 where the tubes 10 cover substantially all the width 1 of the floor pan, it suffices that the mass of the front plate 9 is greater than that of the reinforcement parts 10.

All the tubes here have the same diameter and are in side-by-side contact. The same level of protection is thus ensured over the entire surface of the floor pan 7. The tubes are fastened to the front plate 9 by static retention means, for example, bonding, flanges, spot welding, and the like.

The device according to the invention operates as follows.

When the mine 5 is ignited, pressure is exerted on the front plate 9 which is sufficiently resistant to consume part of the mine's energy, and to stop splinters and projections. The dimensions of the front plate 9 enable it to be given sufficient rigidity enabling part of the energy received to be communicated to the tubular reinforcement parts 10.

These reinforcement parts are dimensioned to be able to deform in flexion and compression in a relatively localized manner thus enabling, with a reduced volume, part of the energy produced by the blast of the mine 5 to be consumed. Moreover, they have the property of having a bending inertia moment that is sufficient to participate in the stiffness of the floor pan for protection perpendicular to the mine.

Furthermore, by positioning at least two profiled reinforcement parts in contact with one another, the level of protection is improved for a minimal protection mass. Indeed, the deformation of the front plate 9 is attenuated because of the proximity of the reinforcement parts and by the increase in stiffness resulting from their mutual contact. Two reinforcement parts in contact have an overall stiffness effect which is improved with respect to that of the same two parts positioned at a distance from one another.

By proposing to position these reinforcement parts on the area of floor pan which is sought to be protected, the invention thereby enables a better trade-off between a reduced protection mass and an optimal level of protection.

It is thus possible for effective protection to be provided for the floor pan 7 of the vehicle at a relatively low thickness of protection, for example, E less than 200 mm, thereby enabling the protection of the floor pans of vehicles with low ground clearance.

Moreover, the reinforcement parts 10 enable the floor pan 7 of the vehicle to be rigidified and thus its deformation further to the explosion of a mine to be limited.

In other embodiments, other types of deformable reinforcement parts may be used, for example profiled parts with a different section, for example, polygonal or elliptical, or bracket-shaped profiled parts or T-sectioned beams may be used.

However, the cylindrical shape is that which ensures the best trade-off between the deformation capability, the bending inertia moment and the reduced volume.

Someone skilled in the art will easily dimension the tubes, which may vary in type of material, length and thickness, and the front plate according to the protection characteristics required for a given vehicle.

Figure 3:
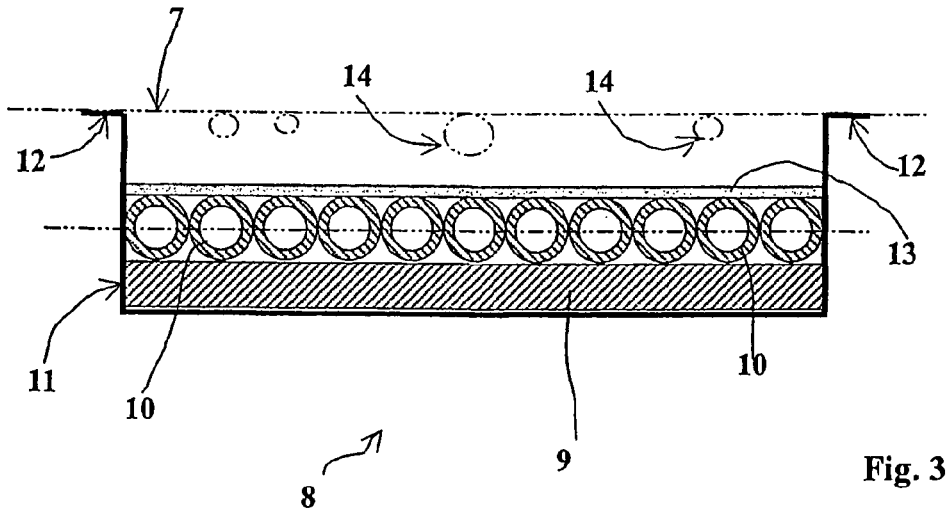
FIGS. 3, 4 and 5 show other embodiments of the device according too the invention.

FIG. 3 shows a protection device according to another embodiment which only differs from the previous one in the presence of a rear plate 13 integral with the reinforcement parts and acting merely to hold the tubes.

The two plates 9 and 13 as well as the reinforcement parts 10 are made integral with a case 11 forming a protection casing able to be adapted to a vehicle floor pan, for example using fastening lugs 12.

In this embodiment, the reinforcement parts 10 are deformed between the two plates 9 and 13. The casing 8 is thus autonomous and it is possible for it to be fastened at a distance from the vehicle's floor pan 7.

It is thus possible for a vehicle in which the transmission mechanisms 14 are positioned below the floor pan 7 to be protected.

Figure 4:
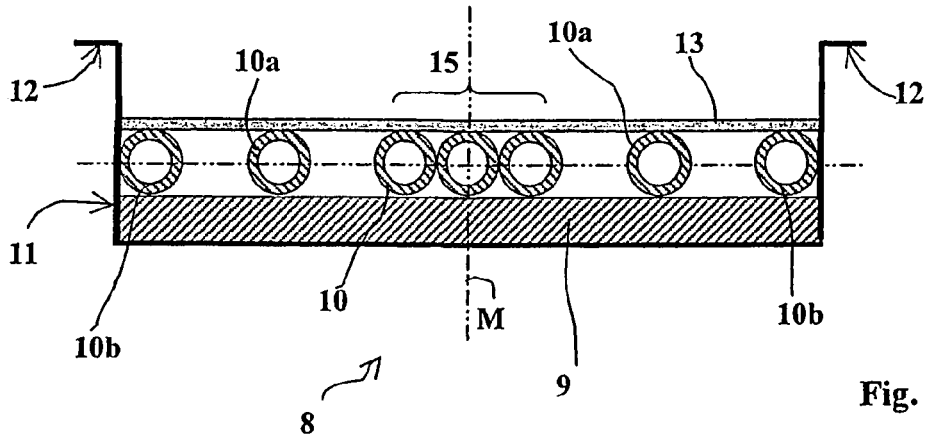

According to the embodiment shown in FIG. 4, the reinforcement parts 10 do not cover all the surface of the floor pan.

A row 15 of three tubular reinforcement parts 10 is thus arranged at a median part M of the front plate 9.

Separate reinforcement parts 10*a* and 10*b* are arranged at a distance on both sides of this median row 15.

This embodiment enables the mass of the protection device to be reduced. It is, in fact, essential for the median part of the floor pan to be protected since it is here that the pressure generated by the ignition of a blast-effect mine is at its highest.

The peripheral reinforcement parts 10*a* and 10*b* improve the distribution of the stresses communicated by the front plate 9.

Figure 5:
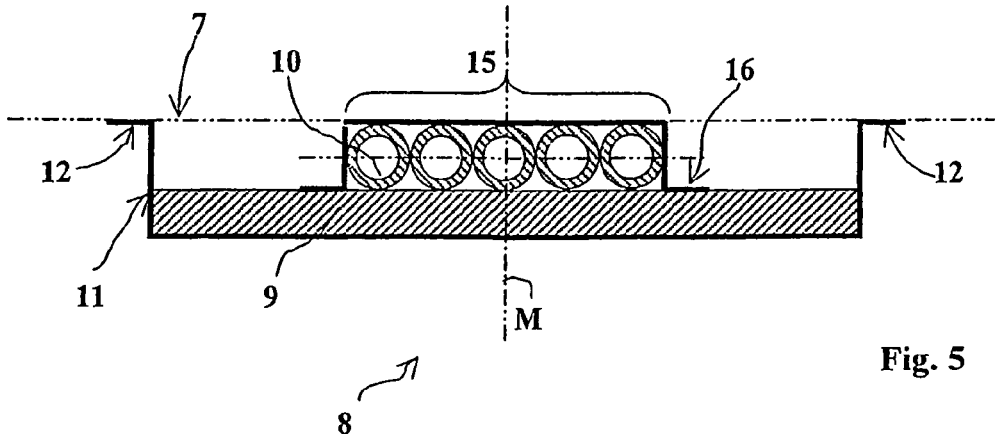
Figure 6:
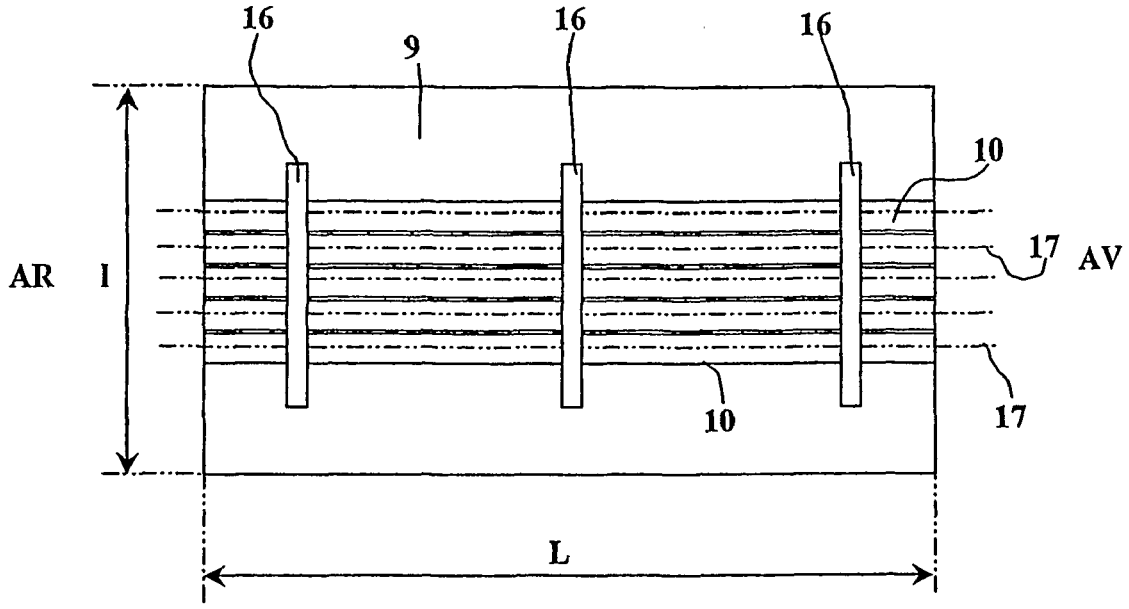
FIG. 6 is a top view of the protection device according to FIG. 5.

It is naturally possible to position the reinforcement parts 10 only at the median part M. FIGS. 5 and 6 thus show such an embodiment in which the median row 15 incorporates five reinforcement parts 10.

According to this embodiment, the reinforcement parts 10 of the median row are made integral with the front plate 9 using flanges 16 of sheet metal, welded to the front plate 9. Also see FIG. 6.

The assembly will be fastened to the vehicle floor pan by any suitable means, for example, fastening lugs 12.

It is also possible for the previous embodiments to be combined, for example for a device to be made that is analogous to that in FIG. 4 but which does not have a rear plate 12. In this case, the tubular reinforcement parts will be fastened to the front plate 9, for example by sheet metal collars. The assembly will then be applied against a floor pan 7 of the vehicle.

In all the embodiments described up to now, the front plate 9 is substantially rectangular with a width 1 and length L which are substantially those of the floor pan of the vehicle to be protected. Furthermore, the tubular reinforcements 10 have their axes 17 parallel to the vehicle's longitudinal axis, shown here by the length L of the front plate 9. See FIG. 6.

It is possible for tubular reinforcements 10 to be positioned which have a different orientation.

Figure 7:
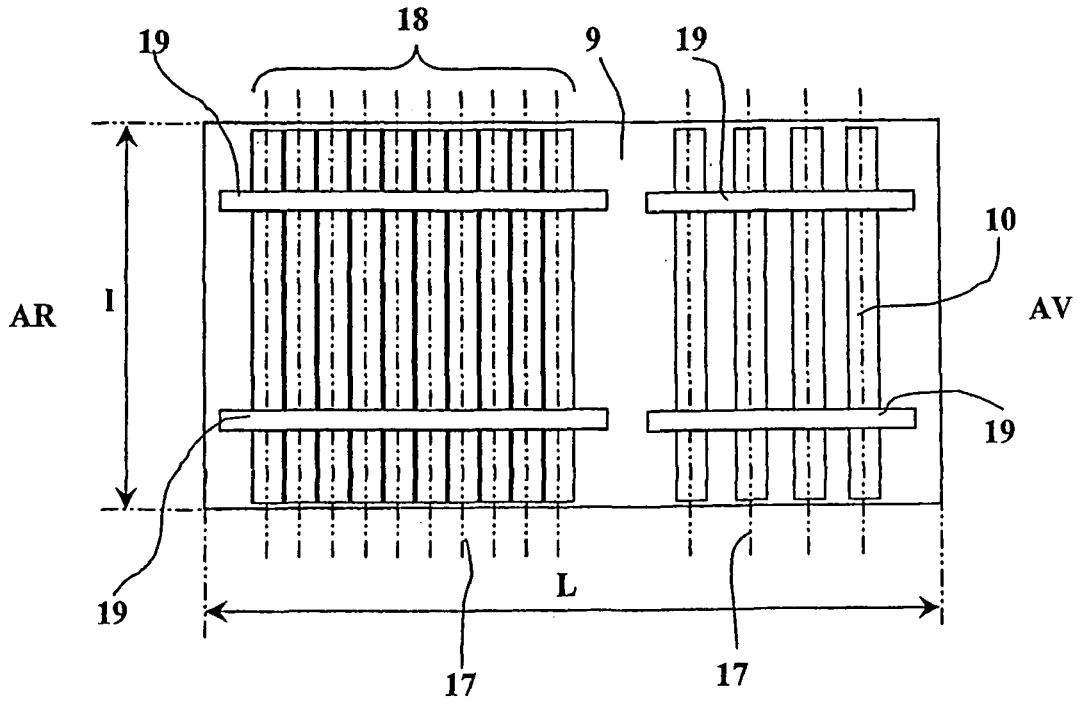
FIG. 7 is a top view of a variant protection device according too the invention.

FIG. 7 thus shows a protection device in which the tubular reinforcements 10 have their axes 17 perpendicular to the vehicle's longitudinal axis, and thus parallel to the width 1 of the front plate 9.

A first row 18 of reinforcement parts 10 arranged next to each other, two-by-two, is positioned near the rear part AR of the device here, positioned to the rear of the vehicle's floor pan 7. Other separate reinforcement parts 10 are arranged towards the front part AV of the device. The reinforcements 10 are preferably positioned in the most vulnerable zones, namely, the cab.

Such an arrangement also enables the device to be made lighter. The tubular reinforcements are more numerous to the rear of the vehicle since it is here, near the cab, that maximal protection must be ensured, and thus where the energy absorbing capacity must be the greatest. The number of tubes may be reduced for the less vulnerable zones, like the drive train, for example.

Once again, the reinforcement parts are made integral with the base plate using flanges 19.

The previous figures show reinforcement parts 10 of a length substantially equal to the length L or width 1 of the front plate 9.

It is also possible for the protection device to be made with reinforcement parts of a smaller length. When defining the protection device, the reinforcements will be concentrated on the zone which most needs to be protected.

The invention claimed is:

1. A protection device to protect a floor pan of a land vehicle against mines, the device comprising:

a planar front plate, and a single layer of stiff, tubular, plastically deformable reinforcement parts positioned between said front plate and a planar rear plate, said deformable reinforcement parts for absorbing explosive energy by deforming in compression or flexion, wherein at least two reinforcement parts are in contact with one another and located at a substantially median part (M) of the front plate, and the surface density of the front plate is greater than that of the deformable reinforcement parts.

2. A protection device according to claim 1, wherein the ratio of the surface density of the reinforcement parts to the surface density of the front plate is less than 0.7.

3. A protection device according to claim 2, wherein the reinforcement parts comprise at least one row of at least two cylindrical tubes.

4. A protection device according to claim 1, wherein the device comprises one row of said reinforcement parts side-by-side in contact with one another and spaced over substantially the entire area of the floor pan.

5. A protection device according to claim 4, wherein the front plate is rectangular and the reinforcement parts have axes parallel with a length (L) of the front plate.

6. A protection device according to claim 4, wherein the front plate is rectangular and wherein the reinforcement parts have axes parallel with a width of the front plate.

7. A protection device according to claim 1, wherein the rear plate comprises a floor pan of a vehicle.

8. A protection device according to claim 1, wherein the rear plate is integral with the front plate and the protection device comprises a protective casing adaptable to the floor pan of a vehicle.

9. A protection device according to claim 2, wherein the device comprises at least two reinforcement parts in contact with one another and located at a substantially median part (M) of the front plate.

10. The protection device according to claim 1, wherein said deformable reinforcement parts directly contact said rear plate.

11. The protection device according to claim 1, wherein each deformable reinforcement part directly contacts an adjacent deformable reinforcement part.

12. The protection device according to claim 5, wherein each deformable reinforcement part has a length substantially equal to the length of the front plate.

13. The protection device according to claim 6, wherein each deformable reinforcement part has a length substantially equal to the width of the front plate.

14. The protection device according to claim 1, wherein the tubular reinforcement parts have a cylindrical shape.

15. The protection device according to claim 1, wherein the front plate is sufficiently resistant to absorb a portion of the energy of an exploding mine, and to stop splinters and projectiles.

16. The protection device according to claim 1, wherein separate reinforcement parts are arranged at a distance on both sides of a median row of reinforcement parts.

17. The protection device according to claim 1, wherein tubular reinforcement parts are fastened to the front plate.

* * * * *